US007998283B2

(12) United States Patent
Yang

(10) Patent No.: US 7,998,283 B2
(45) Date of Patent: Aug. 16, 2011

(54) RARE EARTH ANISOTROPIC HARD MAGNETIC MATERIAL AND PROCESSES FOR PRODUCING MAGNETIC POWDER AND MAGNET USING THE SAME

(76) Inventor: Yingchang Yang, Beijing (CN)

( * ) Notice: Subject to any disclaimer, the term of this patent is extended or adjusted under 35 U.S.C. 154(b) by 611 days.

(21) Appl. No.: 11/735,379

(22) Filed: Apr. 13, 2007

(65) Prior Publication Data

US 2008/0066575 A1 Mar. 20, 2008

(30) Foreign Application Priority Data

Sep. 19, 2006 (CN) ..... 2006 1 0113209

(51) Int. Cl.
*H01F 1/059* (2006.01)

(52) U.S. Cl. ..... 148/301; 148/101

(58) Field of Classification Search ..... None
See application file for complete search history.

(56) References Cited

U.S. PATENT DOCUMENTS

| | | | | |
|---|---|---|---|---|
| 5,478,411 | A * | 12/1995 | Coey et al. | 148/122 |
| 5,750,044 | A * | 5/1998 | Yoneyama et al. | 252/62.54 |
| 6,413,327 | B1 | 7/2002 | Okajima et al. | |
| 6,707,361 | B2 * | 3/2004 | Blume | 335/296 |
| 6,863,742 | B2 * | 3/2005 | Ohashi | 148/103 |

FOREIGN PATENT DOCUMENTS

| | | |
|---|---|---|
| CN | ZL89101552.3 | 12/1994 |
| CN | 163914 | 11/2000 |
| EP | 0369097 | 5/1990 |
| EP | 0453270 | 10/1991 |

OTHER PUBLICATIONS

Yang, Y. et al. Neutron Diffraction Study of Ternary Nitrides of the Type $R_2Fe_{17}N_x$, pp. 6018-6020, J. Appl. Phys. 70 (10), Nov. 15, 1991, American Institute of Physics.

* cited by examiner

*Primary Examiner* — John P Sheehan
(74) *Attorney, Agent, or Firm* — Perkins Coie LLP

(57) ABSTRACT

The disclosure provides a rare earth anisotropic hard magnetic material, which has, on atomic percent basis, a composition of $(Sm_{1-\alpha}R_\alpha)_xFe_{100-x-y-z}M_yI_z$, wherein, R is Pr alone or a combination of Pr with at least one rare earth element selected from the group consisting of La, Ce, Nd, Gd, Tb, Dy, Ho, Er, Tm, Yb, Lu and Y; M is at least one element selected from the group consisting of Si, Ti, V, Cr, Mn, Co, Ni, Cu, Zn, Nb, Mo, Al, and Zr; I is N alone or a combination of N and C; $0.01 \leqq \alpha \leqq 0.30$; $7 \leqq x \leqq 12$, $0.01 \leqq y \leqq 8.0$, $6 \leqq z \leqq 14.4$, and which anisotropic rare earth hard magnetic material is crystallized in a $Th_2Zn_{17}$-type structure, of which crystalline grains are in a flake shape with a gain size ranging from 1 to 5 μm, and c-axis of the crystalline grains, an easy magnetization direction, being oriented along the minor axis of the flake crystalline grains. The disclosure also provides a process for producing the powdery rare earth anisotropic hard magnetic material and a process for producing anisotropic calender flexible magnet.

18 Claims, 6 Drawing Sheets

RARE EARTH ANISOTROPIC HARD MAGNETIC MATERIAL AND PROCESSES FOR PRODUCING MAGNETIC POWDER AND MAGNET USING THE SAME

CROSS-REFERENCE TO RELATED APPLICATION

This application claims priority to Chinese Patent Application No. 200610113209.4 filed on Sep. 19, 2006, the disclosure of which is incorporated herein by reference in its entirety.

TECHNICAL FIELD

The disclosure relates to a rare earth anisotropic hard magnetic material, to process for producing anisotropic magnetic powder, and to process for producing anisotropic calender flexible magnets.

BACKGROUND

There are two kinds of rare earth magnets: sintered magnets and bonded magnets. Recently the bonded magnets are developed quickly. According to the different molding techniques, the bonded magnets are classified as compressing magnets, injection magnets, extrusion magnets and calender magnets. The flexible magnets manufactured by using calender technique are easy to machining, and production cost is low. As a result, there is a great potential for the calender magnets in the applications. Up to data ferrite is the unique magnetic material which has an calender anisotropy and it has been used with a great quantity to produce calender magnets. Although ferrite possesses calender anisotropy, unfortunately, it is ferromagnetic. Its magnetization is low. The maximum energy product of the calender magnets made by ferrite is limited of 5.6-13.6 kJ/$m^3$ (0.7-1.7 MGOe). It is hard to meet the demand to the magnets with small-scale and high performance.

Among the rare earth hard magnetic materials, the NdFeB magnetic powders manufactured by rapid quenching technique are extensively used to produce bonded magnets. However, the NdFeB magnetic powders have some problems when using to make calender magnets. Since their particle size is not small enough, when the NdFeB magnetic powders are used to make calender magnets, the resulted calender magnets have poor flexibility and rough surface, and thus are not satisfied for an ideal machinability. In addition, the NdFeB magnetic powder manufactured by rapid quenching technique is isotropic. Since the NdFeB magnetic powder doesn't present calender anisotropy, the performance of calender magnets based on the magnetic powder is limited. As to the anisotropic rare earth hard magnetic materials, such as Sm—Co magnetic powder or anisotropic NdFeB magnetic powder prepared by HDDR (Hydrogenation, Disproportionation, Desorption, Recombination) process, the term of anisotropy here is only denoted as magnetocrystalline anisotropy. The powders can be oriented when applying a magnetic field. The powders can be used to produce anisotropic compressing or injection magnets with a magnetic field. However, the powders don't present a calender anisotropy. As an example of Sm—Co powder, because it doesn't have calendar anisotropy, the calendar magnets based on Sm—Co powder are isotropic, and its maximum energy product is low, thus having no significance for commercial applications.

Around 1990, J. M. D. Coey et al. disclosed a material having a molecular formula of $Sm_2Fe_{17}N_\delta$ (J. M. D. Coey et al., "Rare Earth based magnetic materials, production process and use". European patent Application number: 91303442.7); Iriyama Kyohiko et al. disclosed a similar material based on rare earth, iron, nitrogen and hydrogen (CN 89101552.3); Yingchang Yang et al. made a neutron diffraction study to determine the crystallographic structure of the compounds $R_2Fe_{17}N_x$, indicating the nitride compounds are crystallized in the $Th_2Zn_{17}$-type structure, and nitrogen atoms occupy a specified interstitial site (Yingchang Yang et al. (1991) Neutron diffraction study of ternary nitrides of $R_2Fe_{17}N_x$, Journal of Applied Physics, 70(10): 6018). Due to the interstitial atom effect, the above nitride compound presents a high Curie temperature Tc, a large saturation magnetization Ms, and a strong magnetocrystalline anisotropic field Ha. As a result it is considered as a good candidate for developing a hard magnetic material with strong coercive force iHc, large remanence Br and high maximum energy product $(BH)_{max}$. How to develop the rare earth-iron-nitrogen based hard magnetic material, people made a great effort. The techniques of smelting, rapid quenching, mechanical alloying, reduction-diffusion, strip-casting, HDDR etc have been applied to produce the different kinds of magnetic powder based on rare earth-iron-nitrogen. However, it is never related to an anisotropic magnetic powder technique for producing anisotropic flexible calender magnets. In addition, it was found that the anisotropic $Sm_2Fe_{17}N_\delta$-type magnetic powder presents a large coercive force when the grain size of the powder is only in the range of few μm. However, the magnetic powder with grain size in few μm is easy to oxidize in the atmosphere at room temperature. Accordingly its magnetic properties decline with time because of the oxidation. In particular during the summer season with high humidity the situation is worse. For example of $Sm_2Fe_{17}N_3$ powder with a size in 1-3 μm, the intrinsic coercive force at room temperature is measured at the beginning as 11.5 kOe. After 10 weeks, it decreases to 7.0 kOe. Although the remanence doesn't change too much, as the coercive force reduces seriously, the maximum energy product decreases too. The problem of stability is a big trouble in the practical use.

In order to resolve the problem of stability, it was suggested to prepare powder with a large grain size which contains many small crystal by using the techniques of rapid quenching, machinery alloying or HDDR etc. As indicated by ZL 99800830.3, the strip-casting method is used to produce master alloy, then followed by a treatment of hydrogenation, disproportionation, desorption, recombination and nitrogenation. The magnetic powder is obtained. The crystal size is less than 1 μm, its average diameter is in a range of 0.1-1.0 μm. That allows to create a large coercive force. However, the average diameter of the powder is 10-300 μm, that improves the stability of the powder. However, the powder is isotropic. That means the stability of the powder is improved at the cost of reducing its magnetic performance, and said powder is merely used to produce isotropic molding magnets.

In brief up to date the magnetic powder based on rare earth-iron-nitrogen obtained by using different manufacture methods or adding various elements is either isotropic, or anisotropic only when applying a magnetic field. All of them don't present a calender anisotropy. Obviously the above powder cannot be used to produce anisotropic calender magnets. In order to satisfy the requirement of reducing the scale of device, it is need to develop various anisotropic rare earth bonded magnets with high performance, especially anisotropic flexible calender magnetic. At the same time in order to meet the requirement of practical use it is necessary to resolve the problem of stability of the anisotropic magnetic powders.

However, there is no any rare earth hard magnetic material can satisfy the above requirements to date.

DETAILED DESCRIPTION

Figure 1:
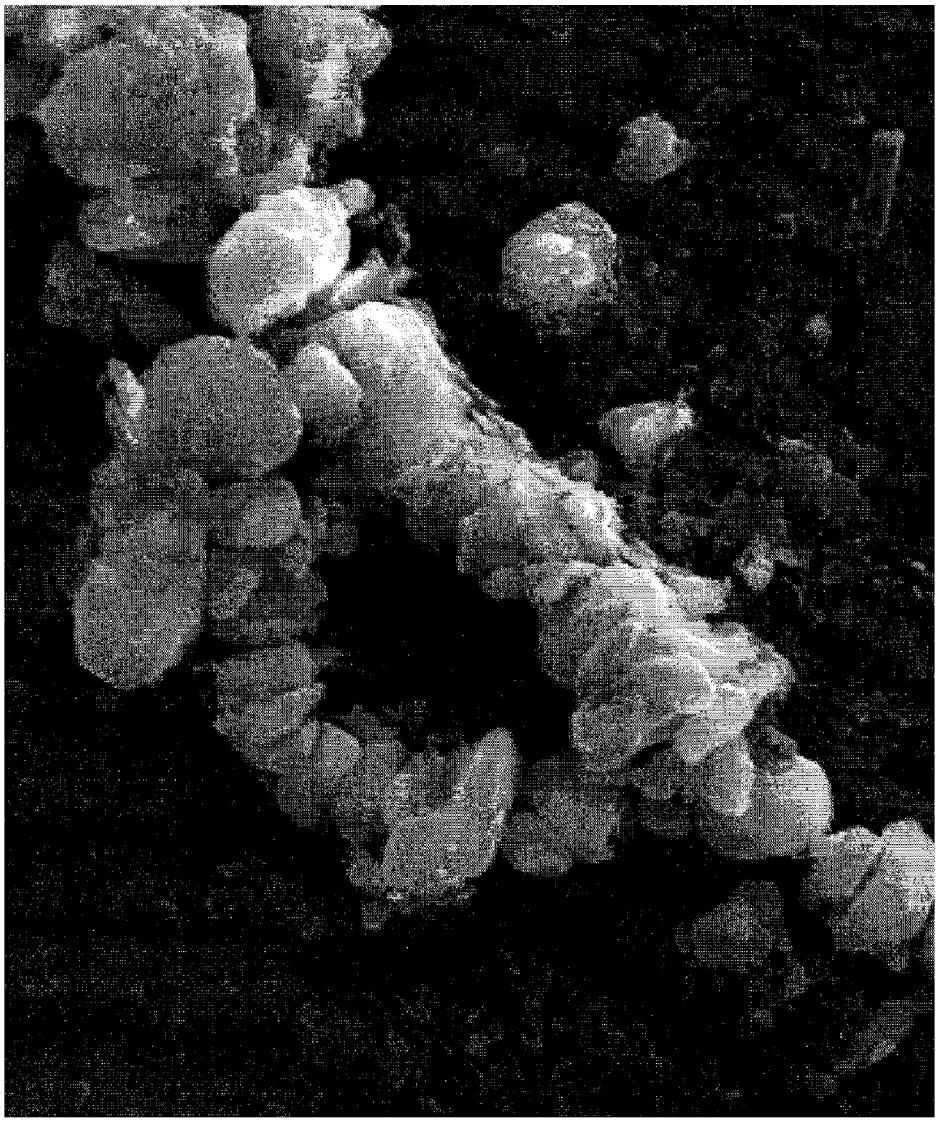
FIG. 1 shows SEM observation of $Sm_{8.2}Pr_{1.3}Fe_{bal}Si_{0.8}Vi_{2.6}N_{14.2}$ magnetic powder. The magnetic powder was magnetized with a pulse magnetic field before the observation.

One aspect of several embodiments is directed to rare earth hard magnetic material able to not only prepare anisotropic bonded magnets by using compressing, extrusion and injection techniques, but also to prepare anisotropic calender magnets. Another aspect is directed to an all-round anisotropic rare earth magnetic material. At the same time the magnetic powder has a good stability.

Another aspect of several embodiments is directed to provide a process for preparing above-mentioned anisotropic hard magnetic powder. A further aspect is to provide a process for preparing anisotropic flexible calender magnets based on the above-mentioned anisotropic hard magnetic powder.

The composition of the magnetic powder based on rare earth-iron-nitrogen and process for preparing the magnetic powder are modified. As a result the hard magnetic material provided in the present disclosure possesses not only the anisotropy when applying a magnetic field, but also possesses calender anisotropy and magnetoelastic anisotropy. Based on the above three kinds of anisotropy, a process for preparing the anisotropic calender magnets has been developed.

Specifically, there is provided an anisotropic rare earth hard magnetic material, which has, on atomic percent basis, a composition of:

$$(Sm_{1-\alpha}R_{\alpha})_xFe_{100-x-y-z}M_yI_z$$

wherein, R is Pr alone or a combination of Pr with at least one rare earth element selected from the group consisting of La, Ce, Nd, Gd, Tb, Dy, Ho, Er, Tm, Yb, Lu and Y; M is at least one element selected from the group consisting of Si, Ti, V, Cr, Mn, Co, Ni, Cu, Zn, Nb, Mo, Al, and Zr; I is N alone or a combination of N and C, $0.01 \leqq \alpha \leqq 0.30$; $7 \leqq x \leqq 12$, $0.01 \leqq y \leqq 8.0$, $6 \leqq z \leqq 14.4$, and they are crystallized in a $Th_2Zn_{17}$-type structure, of which crystalline grains are in a flake shape with a gain size ranging from 1 to 5 μm, and c-axis of the crystalline grains, an easy magnetization direction, being oriented along the minor axis of the flake crystalline grains. x, y, and z are expressed by atomic percent.

As mentioned in the background of the disclosure, for a composition of rare earth nitrides hard magnetic material with the $Th_2Zn_{17}$-type structure, Sm, Fe and N are necessary. Regarding the composition of the material provided in the present disclosure, a combination of $(Sm_{1-\alpha}R_{\alpha})_x$ and an addition element of M are used. Moreover, the value of α and y has a certain range. In addition, the material provided in the present disclosure has the following features:

First, In the combination of $(Sm_{1-\alpha}R_{\alpha})$, Sm does not exist alone. In other words, the value of α is not zero; instead α is from 0.01 to 0.30, and preferably from 0.1 to 0.30;

Second, R denotes Pr alone or a combination of Pr and at least one other element selected from the group consisting of La, Ce, Nd, Gd, Tb, Dy, Ho, Er, Tm, Yb, Lu and Y. However, Pr can be partially substituted by at least another rare earth element. In this case, R is expressed as $Pr_{1-\beta}R'_{\beta}$, wherein R' is at least one rare earth element selected from the group consisting of La, Ce, Nd, Gd, Tb, Dy, Ho, Er, Tm, Yb, Lu and Y. When Pr is partially replaced by another element R', for example Nd, Gd, or Y etc., R'/Pr+R' is not higher than 0.05, i.e., $\beta<0.95$. Moreover, the atomic percent of Pr in the combination of $(Sm_{1-\alpha}R_{\alpha})$ is not less than 1%.

Third, M is preferably selected from Si, V, Ni or a combination of Si and M, such as Si—V, Si—Ni, or Si—V—Ni.

Fourth, N can be partially replaced by C when the atomic percentage of N in the combination of N and C is not less than 50%, i.e., N/N+C is no less than 50%.

Examples of the rare earth anisotropic hard magnetic material represented by the formula $(Sm_{1-\alpha}R_{\alpha})_xFe_{100-x-y-z}M_yI_z$ include:

$Sm_{7.7}Pr_{1.4}Fe_{76.3}Si_{1.0}N_{13.6}$
$Sm_{8.0}Pr_{1.0}Fe_{bal}V_{3.5}N_{14.0}$
$Sm_{8.0}Pr_{1.0}Nd_{0.2}Fe_{bal}Si_{0.5}V_{3.0}N_{14.0}$
$Sm_{7.8}Pr_{1.2}Fe_{bal}Si_{0.8}V_{3.0}N_{14.0}$
$Sm_{9.0}Pr_{1.2}Fe_{bal}Ni_{2.0}Si_{0.1}V_{3.5}N_{13.0}$
$Sm_{9.0}Pr_{1.2}Fe_{bal}Si_{0.2}Ni_{3.0}C_{5.0}N_{9.0}$
$Sm_{9.0}Pr_{1.2}Fe_{bal}Ni_{5.0}N_{14.0}$ The process for producing the powdery rare earth anisotropic hard magnetic material of the present disclosure as mentioned above comprises the steps of:

(1) preparing a master alloy with all components of $(Sm_{1-\alpha}R_{\alpha})_xFe_{100-x-y-z}M_yI_z$ except for N by using induction melting or strip-casting technique, (2) treating the master alloy obtained in step (1) in nitrogen atmosphere at 450-600° C. for 4-8 hours to carry out a gas-solid phase reaction, to form a nitride having the composition of $(Sm_{1-\alpha}R_{\alpha})_xFe_{100-x-y-z}M_yI_z$ as defined above; and (3) pulverizing the nitride obtained in step (2) into an anisotropic monocrystal powder having an average particle size of 1-3 μm and being in a flake shape.

The above-mentioned process are used to form monocrystal particles in a flake shape. The master alloy can be prepared by using induction melting or strip-casting technique. However, the strip-casting technique is recommended. The rotation rate of roll is 2-4 meter/second. The obtained cast strips are 0.2-0.5 mm in thickness, and 3-5 cm in width. The master alloy prepared by using strip-casting technique has a proper microstructure. The crystal grains present a flake shape, and the grain size is larger than 1 μm, ranging from 1 μm to 5 μm. Moreover, thus obtained alloy has good single phase, so that the homogeneous heat treatment may be simplified or even avoided. Then the gas-solid phase reaction is carried out in N atmosphere at 450-600° C. for 4-8 hours. After nitrogenation usually a jet mill or a ball mill is used to produce the magnetic powder. The average size of the powder is 1-3 μm. The powder includes of single crystal particles in a flake shape.

The magnetic powder of single crystal particles in a flake shape prepared by using above-mentioned composition and process possesses three kinds of anisotropy:

(1) Calender Anisotropy (Mechanical Anisotropy).

The calendering anisotropy is demonstrated because the magnetic powder is mechanically oriented during the calendering. It is believed that the formation of this orientation is due to the feature of the magnetic particles which are single crystals with a flak shape, see FIG. 1. It is found that the particle's easy magnetization direction, c-axis, is along the minor axis of the particles. During the calendering process, the c-axis is arranged perpendicular to the surface of the magnet. Accordingly, the magnetic moment of the magnet is oriented to produce anisotropic magnet.

(2) Magnetocrystalline Anisotropy

Since the magnetic powder is of single crystals with a grain size of 1-3 μm which easy magnetization direction is the c-axis, when applying a magnetic field, all the particles turn to the same direction along the applied field.

(3) Magnetoelastic Anisotropy

Figure 2:
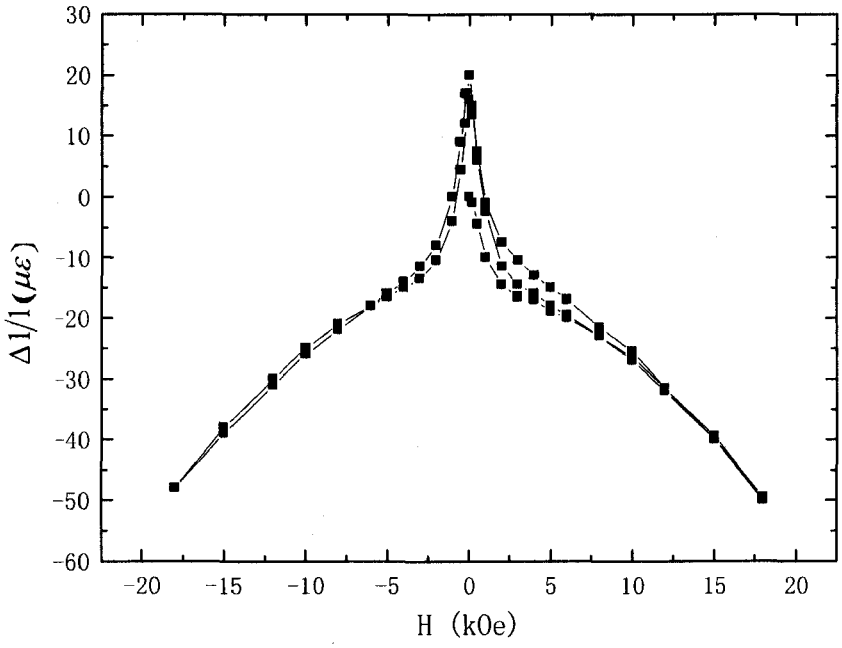
FIG. 2 shows the variation of magnetostriction constant ΔI/I of $Sm_{9.0}Pr_{1.5}Fe_{bal}Si_{1.2}$ as a function of magnetizing field H.
Figure 3:
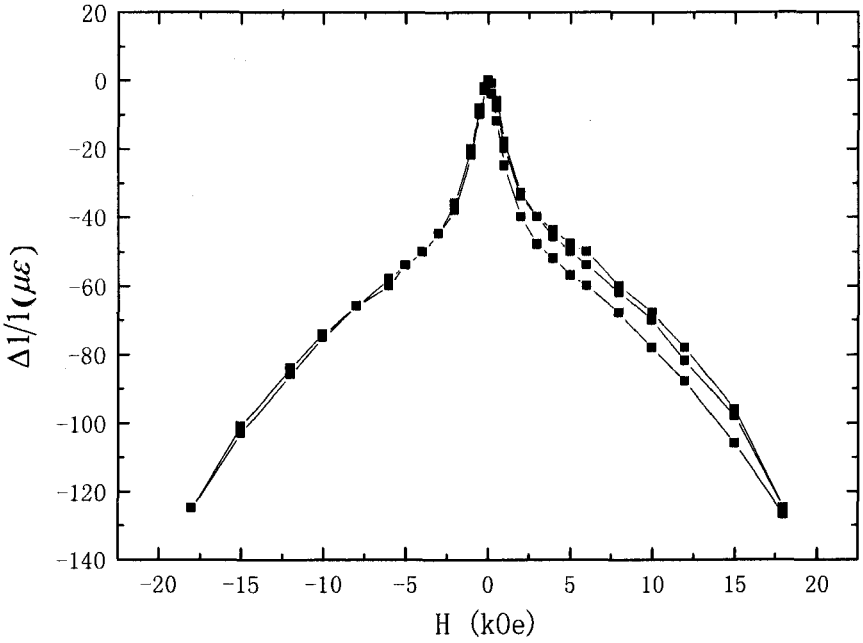
FIG. 3 shows the variation of magnetostriction constant ΔI/I of $Sm_{7.7}Pr_{1.4}Fe_{bal}Si_{1.0}N_{13.6}$ as a function of magnetizing field H.

It is found that the material provided in the present disclosure has a strong magnetostriction effect. When the strip-casting technique is used to prepare the alloy, it is available to measure the magnetostriction effect with the strip samples. The variations of the magnetostriction constant $\lambda(\Delta l/l)$ with applied magnetic field of $Sm_{9.0}Pr_{1.5}Fe_{88.3}Si_{1.2}$ and its nitride $Sm_{7.7}Pr_{1.4}Fe_{76.3}Si_{1.0}N_{13.6}$ are illustrated in FIG. 2 and FIG. 3. The measurements are made along the direction parallel to the magnetic field. Comparing FIG. 3 with FIG. 2, it is indicated that the nitrogenation has a significant effect on the magnetostriction. After the incorporation of N into the lattice, the magnetostriction constant $\lambda$ is increased, so the magnetoelastic energy of the material is enhanced. Moreover, more important fact is that the sign of magnetostriction constant is changed from positive to negative, i.e., $\lambda<0$, see FIG. 3. That means the material is shorten as it is magnetized. According to the magnetoelastic energy, when pressure is applied to the material, if the magnetization direction is parallel to the direction of pressure, the magnetoelastic energy is minimum. That is, in this case the role of a pressure is equivalent to that of a magnetic field.

Based on the anisotropy that the material possesses, a process to produce anisotropic flexible calender magnets is provided. The magnetic powder and some elastomer binder as well as some processing aid can be blended with a weight percent of 78-98%, 1.5-20% and 0.5-10% respectively. Then calendering is carried out by processing the material between rolls. During this process the magnetic powder is mechanically oriented to produce anisotropic magnets. In order to put effectively the magnetic powder in order, the calendering is repeatedly made more than 30 times.

The magnetic particles are single crystals in a flak shape whose average size is larger than 1 μm. Since the easy magnetization direction, c-axis, is parallel to the minor axis of the particles, during the calendering and calender process the strain force produced by the rolls arranges the particle's c-axis perpendicular to the surface of the sheet calender magnets. As a result the magnetic moment is oriented along the minor axis of the sheet magnets. The calender anisotropy can produce this anisotropic calender flexible magnets. However, the orientation is not perfect if it only relies on the calender anisotropy. Therefore, as a supplementary means, the magnetocrystalline anisotropy and magnetoelastic anisotropy are used to improve the orientation.

In order to take the advantage of the magnetocrystalline anisotropy, a magnetic field is applied during the process. There are several ways to do it. The blend can be oriented with an applied field before the calendering. The molding may contain magnetic circuits which are around the rolls. The magnetic circuit may use sintered NdFeB permanent magnets or an electromagnetic system or a pulse magnetic system. During the calendering and calender process the magnetic field in 4-60 KOe is applied to heighten the orientation.

Since the magnetostriction constant of the magnetic powder is characterized by $\lambda<0$, the pressure direction is the easy magnetization direction. As to use the effect of magnetoelastic anisotropy, the calender magnets is heated to 50-100° C., then they are pressed in a magnetic field of 15-20 kOe. The pressure is applied in the same direction as the magnetic field. Heating makes the magnet softened, so that it is easier to be oriented during pressing.

Specifically, the process for producing the anisotropic calender magnets of the present disclosure comprises blending, calendering, calender, magnetic powder coating, magnet vulcanization, magnet magnetizing etc.:

a) Blending: The blend is prepared with magnetic powder, binder and processing aid such as coupling agent, plasticizer, antioxidant and the like in a specific proportion. Before calendering the blend is oriented with an applied magnetic field.

b) Calendering: The calendering process utilizes the above blend with a rolls velocity adjusted.

c) Calender: After calendering, adjusting the rolls to have a desired velocity, the magnets are calendered to obtain a desire shape with a desired dimension.

d) Magnet vulcanization: magnet vulcanization is performed by using infrared vulcanization or electron beam vulcanization with vulcanizing agent such as acid ester or alkyl ester etc.

e) Magnet follow-up treatment: Magnet is heated to 50-100° C., then it is cooled under pressure with a magnetic field of 15-20 kOe to further improve the orientation. The pressure is applied in a direction parallel to the magnetic field. Heating makes the magnet softened, so that it is easier to be oriented during pressing.

f) Finally, the magnet is cut, punched and shaped to the desired dimension.

The elastomer binder used in the present disclosure is chlorosulfonated polyethylene, chlorinated polyethylene, chloroprene rubber, natural rubber, nitrile rubber, cis-1,4-polybutadiene rubber, chlorohydrin rubber, or silicone rubber and the like, or modifiers of the above elastomer. The processing aid used in the present disclosure may be plasticizer, coupling agent, lubricant, flame retardant, colorant, perfuming agent, or antioxidant and the like.

In addition, on the basis of magnetoelastic anisotropy and magnetocrystalline anisotropy, the magnetic powder provided by the present disclosure may be used to produce anisotropic magnets by employed pressing, extrusion or injection techniques. For example, the magnetic powder blended with thermoset binder, such as epoxy resin, acrylic resin or phenolic resin and the like, is pressed in a magnetic field, then followed by solidification and shaping, the anisotropic pressing magnets are formed. If the magnetic powder blended with thermoplastic binder, such as polyamide, polyester, polyphenylene sulfide (PPS), polyvinyl chloride (PVC), low density polyethylene (LDPE) and the like, then the injection molding is made with a magnetic field to produce anisotropic injection magnets.

The Effect of the Present Disclosure

Aspects of several embodiments are directed to adding Pr and M (M is selected from Si, Al, and V etc.) in a specific proportion in Sm—Fe—N based material. Two problems regarding the technique applications are resolved.

Figure 4:
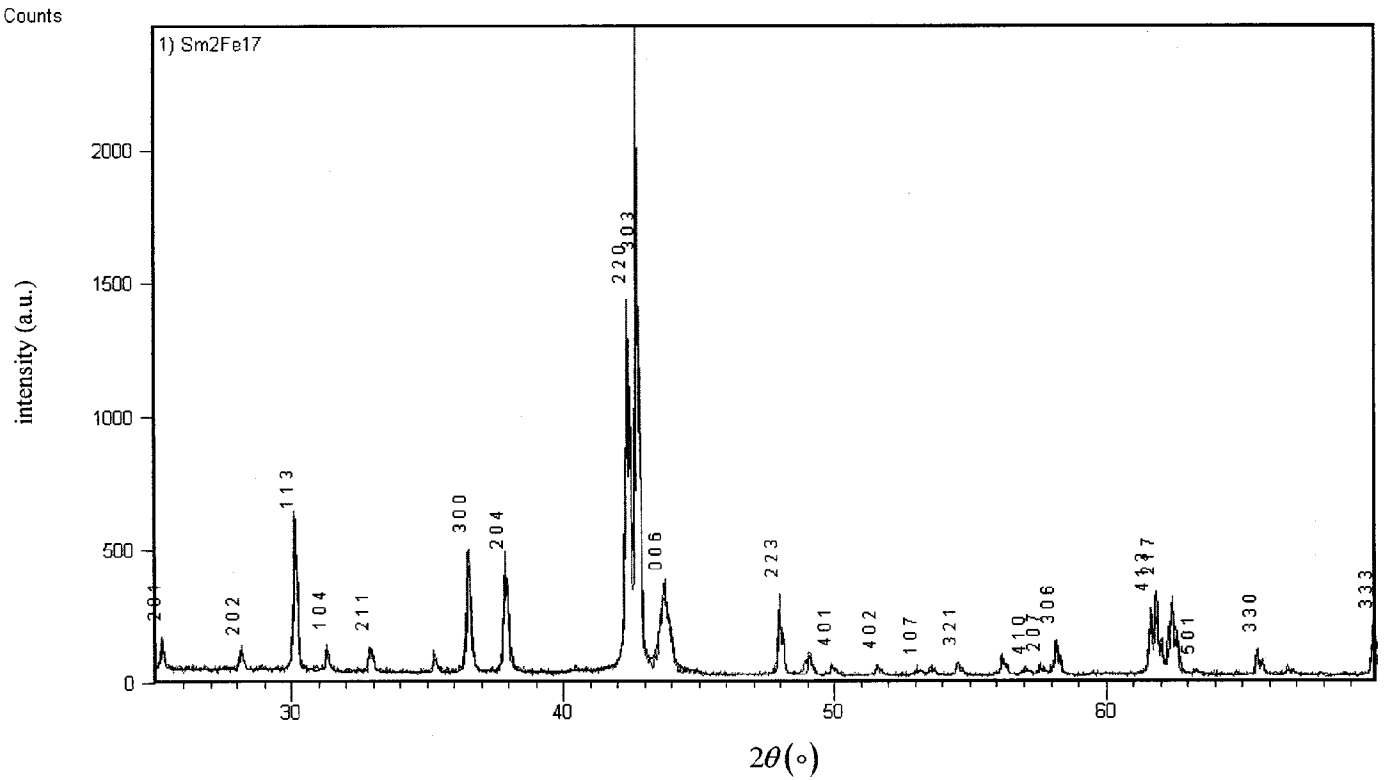
FIG. 4 shows the X-ray diffraction pattern of $Sm_{9.0}Pr_{1.5}Fe_{88.3}Si_{1.2}$.
Figure 5:
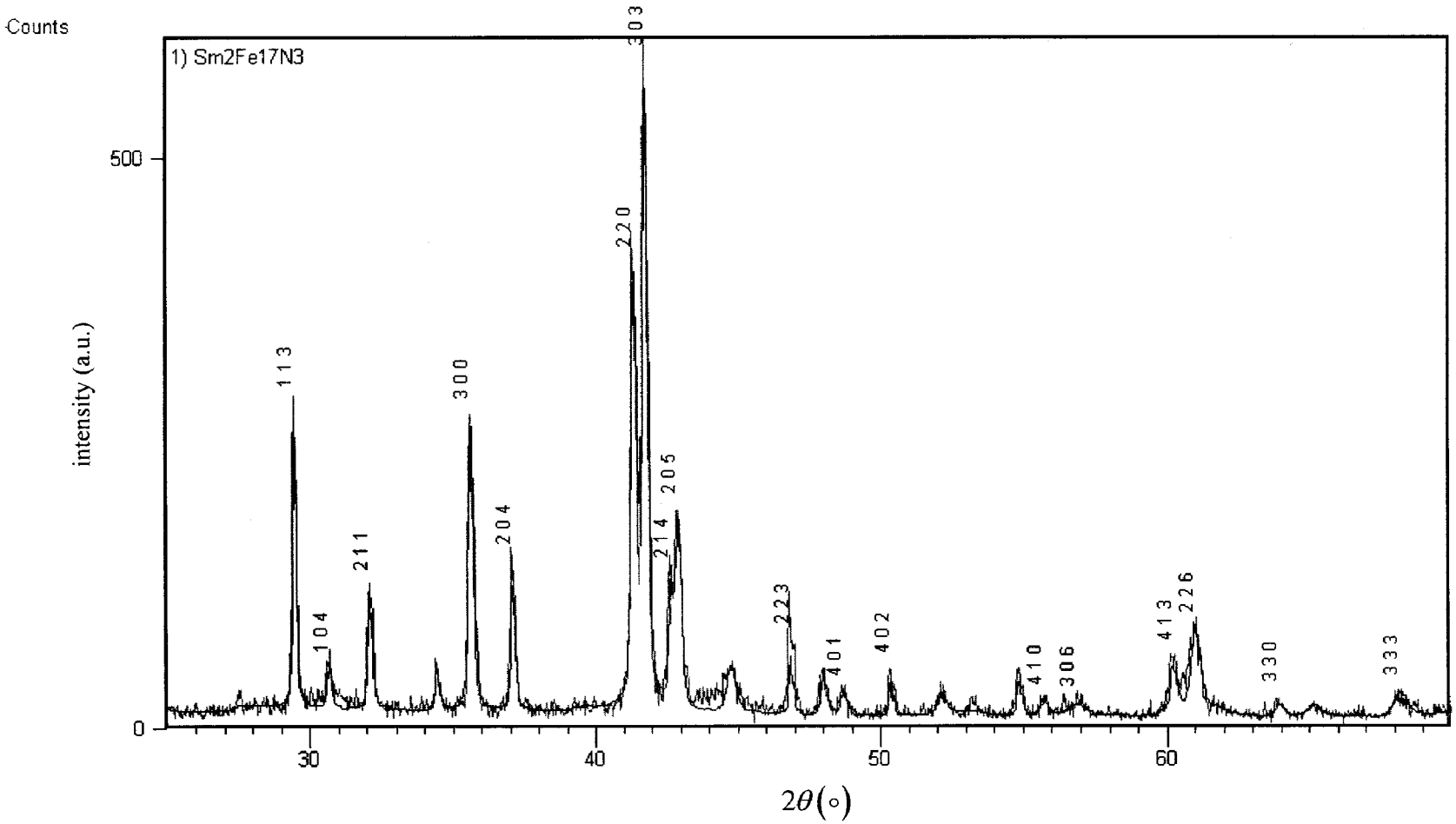
FIG. 5 shows the X-ray diffraction pattern of $Sm_{7.7}Pr_{1.4}Fe_{76.3}Si_{1.0}N_{13.6}$.

Firstly, due to introducing Pr and M at the same time with a proper amount into the material, a good master alloy with a fine single phase can be obtained by conventional melting technique or strip-casting technique. Currently, the alloy of $Sm_2Fe_{17}$ is prepared by using induction melting, reduction-diffusion or rapid quenching technique. Good results are found when strip-casting technique is used to prepare $Nd_2Fe_{14}B$-type alloy. However when the strip-casting technique is used to prepare $Sm_2Fe_{17}$-type alloy, the phase is difficult to be formed or heterophase is formed. In the Chinese Patent No. ZL99800830.3, the strip-casting method was used to prepare the $Sm_2Fe_{17}$-type master alloy, but it is required to follow a hydrogen treatment consisting of the reaction of hydrogenation, decomposition, desorption, recombination to obtain nitride magnetic powder. As to the present disclosure, owing to the addition of Pr and M, the magnetic powder prepared by using strip-casting method has the following advantages:

(1) It is available to prepare the master alloys with the $Th_2Zn_{17}$-type structure and their nitrides formed in a good single phase which is closed to a stoichiometric composition, and inhibit the formation of α-Fe. The single phase is identified by the x-ray diffraction pattern of $Sm_{9.0}Pr_{1.5}Fe_{bal}Si_{1.2}$ and its nitride $Sm_{7.7}Pr_{1.4}Fe_{bal}Si_{1.0}N_{13.6}$, see FIG. 4 and FIG. 5. On the one hand, due to the fine single phase with a stoichiometric composition, the intrinsic magnetic properties are enhanced, that favors to prepare the magnetic powder with high performance. On the other hand, since it is forming in a single phase, so the homogeneous heat treatment is simplified, even avoided. That makes manufacture process simplified. As a result it allows to reduce the manufacture cost.

Figure 6:
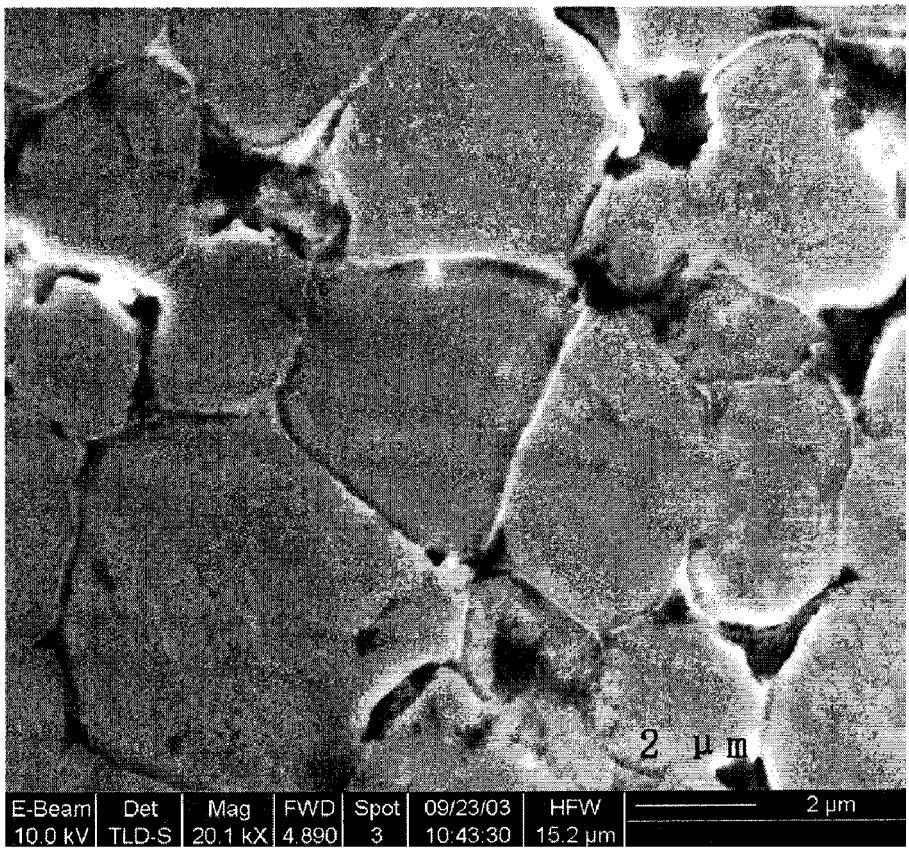
FIG. 6 shows SEM observation of the microstructure of $Sm_{9.0}Pr_{1.5}Fe_{bal}Si_{1.0}Vi_{3.0}$ alloy.
Figure 7:
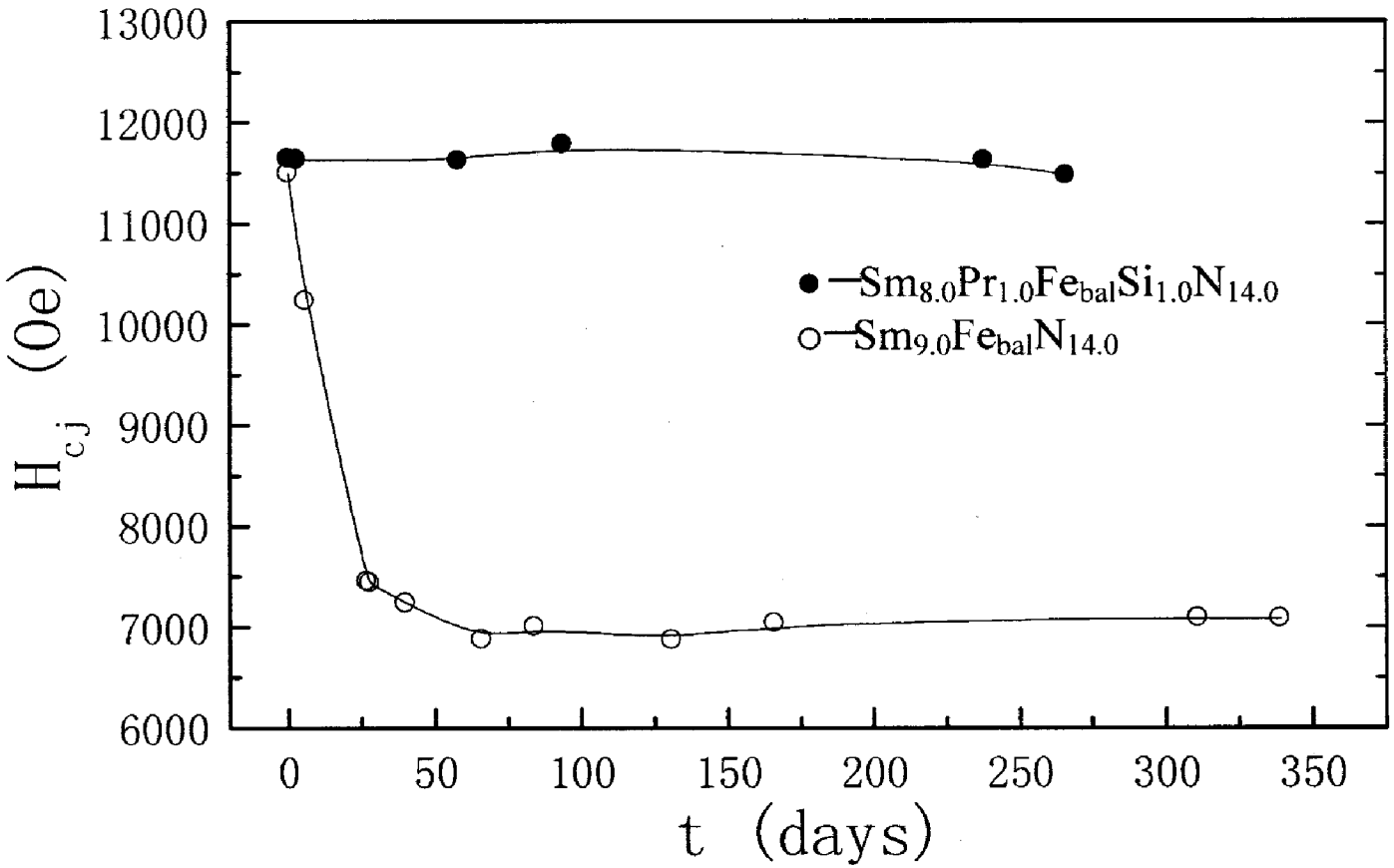
FIG. 7 shows the comparison of the variation of intrinsic coercive force iHc as a function of time between $Sm_{9.0}Fe_{bal}N_{14.0}$ and $Sm_{8.0}Pr_{1.0}Nd_{0.2}Fe_{bal}Si_{0.5}V_{3.0}N_{14.0}$.

(2) SEM observation demonstrates that the addition of Pr and M makes the material having a proper microstructure. As indicated in FIG. 6, which is the microstructure of $Sm_{9.0}Pr_{1.5}Fe_{bal}Si_{1.0}V_{3.0}$ observed by SEM. The observation result shows that most of the crystal grains present a flake form different from a spherical form, and all the crystal grain's size is more than 1 μm. The crystal grains size is in the range from 1 μm to 5 μm, and the average size is 3 μm.

(3) Based on the master alloy which's average size is 3 μm, after nitrogenation, it is easy to obtain magnetic powder consisting of single crystal particles of 1 μm-3 μm. Due to said particle size, the hysteresis loop of the magnetic powder has a large coercive force and a high squareness. As a result, it is allowed to improve the powder's magnetic performance. Moreover, the magnetic particles have a form as flake. Their easy magnetization c-axis is along with the minor axis of the flake particles, i.e., c-axis is perpendicular to the surface of the flake. It is believed that this is the reason for that the magnetic powder in the present disclosure presents a calender anisotropy.

Here it has to point out that since the Stevens factor of Pr $\alpha_J<0$, which is opposite to that of Sm, Pr doesn't present an easy axial magnetocrystalline anisotropy, and M is generally nonmagnetic. So that if the concentration of Pr and M is too large, the intrinsic magnetic properties of the material (anisotropy field Ha, saturation magnetization Ms, and Curie temperature Tc) will decrease, so that the hard magnetic performance of the powder (coercive force iHc, remanence Br, and maximum energy product $(MH)_{max}$) will cut down. Therefore, the contents of Pr and M, i.e., α and y, are restricted in a specific range. The present disclosure discloses the value region of α and y within which, the addition of Pr and M has a positive effect.

Pr can be partially substituted by Nd, Gd, or Y etc. The substitution degree isn't allowed over 95%. The atomic percentage of Pr in $Sm_{1-\alpha}R_\alpha$ is not less than the lower limit of α. In the case that Pr and M are coexisted, Fe can be partially substituted by Mn, Co, or Cr etc, and N can be partially placed by C. All these substitutions favorite for adjusting and improving magnetic powder's performance and stability.

The second, owing to the addition of Pr and M that resolve the ageing problem, the stability with time and temperature of the material with $Th_2Zn_{17}$ type structure is improved. A comparison of the variation of the coercive force as a function of time between $Sm_{9.0}Fe_{bal}N_{14.0}$ and $Sm_{8.0}Pr_{1.0}Nd_{0.2}Fe_{bal}Si_{0.5}V_{3.0}N_{14.0}$ is illustrated in FIG. 6.

Based on the composition and process provided by the present disclosure, the magnetic powder consists of single crystal grains, but not single domains. The coercivity mechanism of the magnetic powder is characterized by nucleation. The coercive force and remanence both vary with particle size, and it appears a maximum at a given particle size. However, the particle size corresponding to the maximum value is not the same for coercive force and remanance. In addition, if the particle size is too fine, it is easy to sudden oxidation. On consideration of all the factors, the optimum particle size is 1.5-3.0 μm.

Regarding to prepare the master alloy by using strip-casting technique in the present disclosure, there are following significant advantages:

Firstly, it is able to prepare a master alloy which has good single phase and is closed to a stoichiometric composition. Based on said alloy, the nitride has a high saturation magnetization and high Curie temperature. So that the nitride powder has a high remanence at ambient temperature. Moreover, since the master alloy is of single phase, so it is available to prepare the nitrides without heterophase. As a result the nucleation intensity is enhanced. So that a high coersive force and a good squareness are obtained. Secondly, the particles have a flake shape. Thirdly, making the crystal grain size fined and well distributed, it helps to obtain magnetic powder consisting of single crystal grains with a size of 1.5-3.0 μm, which have high remanence, high coercive force and high maximum energy product, by using ball or jet milling process.

Based on the three sorts of anisotropies of the magnetic powder possesses, a process to produce anisotropic calender flexible magnets is developed in the present disclosure. First of all, the magnetic particles are mechanically oriented with the mechanical force produced by rolls during the calendering or calender process. The magnetic moments of the particles are perpendicular to the plane of the formed calender sheet magnets. Secondly, making use of the orientation effect of monocrystal particles in a magnetic field, a magnetic field is applied during the process to produce anisotropy calender magnets. Before the calendering, the bend consisting of magnetic powder, binder and other ingredients is oriented in an applied field. Then, setting a magnetic circuit around the rolls, an magnetic field is applied during the calendering process. Finally, heating the formed calender magnets to 50-100° C., then it is cooled in a pressure with a magnetic field of 10-20 kOe. The pressure is in the same direction of the applied field. Using the effect of magnetoelastic anisotropy helps to further improve the orientation.

Besides the excellent magnetic properties, the flexible calender bonded magnets prepared by using the material and the manufacture technique provided by the present disclosure have good mechanic and related properties, such as fine and smooth surface, strong tensile and stretch intensity, proper hardness and excellent flexibility, and satisfied properties of heat resistance, humidity resistance, oil resistance, and corrosion resistance.

To sum up, the present disclosure provides an all-round anisotropic hard magnetic material, which can make not only anisotropic compressing magnets, anisotropic injection magnets, and anisotropic extrusion magnets, but also anisotropic calender magnets. The anisotropic calender magnets prepared by the process of the present disclosure have not only high magnetic performance, but also excellent flexibility and strong corrosion resistance, and thus make up for the present lack of magnet now available. The magnetic performance and related practicality properties what the magnets of the present disclosure possessed meet the requirement from the market need to high quality flexible magnets.

EXAMPLES

To assist in understanding the present disclosure, the following examples are included which describe the results of a series of experiments. The experiments relating to the present disclosure should not, of course, be construed as specifically limiting the disclosure.

Example 1

A master alloy is prepared by using strip-casting technique with the composition of Sm, Pr, Fe, Si as listed in Table 1, followed by a heat treatment in nitrogen gas at a temperature of 450-600° C. for 4-6 hours (to have an optimal condition for gas-solid phase reaction, the temperature and time of the heat treatment are adjusted according to the modification of composition). Then the resulted nitrides are pulverized by using ball mill. Magnetic powder is obtained with an average particle size of 1.5 μm. Then the magnetic powders are stored in air (from the first day of July to the first day of November). It was found that the remanence doesn't change much, however, the coercive force cuts down significantly, as a result the maximum energy product decreases too. From the comparison indicated in table 1, it can be seen that the magnetic powder with Pr and M has excellent magnetic properties with a good stability.

TABLE 1

The variation of coercive force iHc and maximum energy product $(BH)_{max}$ with time of $Sm_2Fe_{17}N_x$ type magnetic powder and magnetic powder with Pr and M

| | composition (atom %) | | | | | iHc (kOe) | | $(BH)_{max}$ (MGOe) | |
|---|---|---|---|---|---|---|---|---|---|
| No. | Sm | Pr | Fe | M | N | At starting | After 10 weeks | At starting | After 10 weeks |
| 1 (Comparative example) | 9.0 | 0.0 | bal | 0.0 | 14.0 | 11.8 | 7.0 | 33.6 | 26.0 |
| 2 (comparative example) | 9.0 | 1.0 | bal | 0.0 | 14.0 | 11.9 | 9.5 | 33.5 | 28.5 |
| 3 (comparative example) | 9.0 | 0.0 | bal | 1.0 (Si) | 14.0 | 10.5 | 9.5 | 31.0 | 28.0 |
| 4 (comparative example) | 9.0 | 0.0 | bal | 1.0 (V) | 14.0 | 11.5 | 9.5 | 32.0 | 27.0 |
| 5 (comparative example) | 9.0 | 0.0 | bal | 1.0 ($Si_{0.2}V_{0.8}$) | 14.0 | 11.8 | 9.5 | 33.5 | 28.5 |
| 6 | 9.0 | 1.0 | bal | 1.0 (Si) | 14.0 | 12.4 | 11.8 | 34.0 | 34.0 |
| 7 | 9.0 | 1.0 | bal | 1.0 (V) | 14.0 | 12.2 | 12.0 | 32.8 | 32.8 |
| 8 | 9.0 | 1.0 | bal | 1.0 ($Si_{0.2}V_{0.8}$) | 14.0 | 12.5 | 12.3 | 36.0 | 36.0 |

Example 2

The magnetic powder of $(Sm_{1-\alpha}Pr_{\alpha})_{9.0}Fe_{bal}Si_{1.0}N_{14.0}$ was obtained by using the process of example 1. The hard magnetic performance of the magnetic powder at room temperature is shown in table 2.

TABLE 2

Variation of the hard magnetic performance of $(Sm_{1-\alpha}Pr_{\alpha})_{9.0}Fe_{bal}Si_{1.0}N_{14.0}$ as a function of α

| α | Br (kG) | iHc (kOe) | $(BH)_{max}$ (MGOe) |
|---|---|---|---|
| 0.00 | 12.5 | 8.5 | 23.0 |
| 0.01 | 12.5 | 10.0 | 30.0 |
| 0.05 | 12.6 | 10.5 | 31.0 |
| 0.10 | 13.0 | 11.8 | 34.0 |
| 0.12 | 13.2 | 12.0 | 37.0 |
| 0.14 | 13.7 | 12.5 | 38.5 |
| 0.16 | 13.5 | 12.3 | 38.0 |
| 0.18 | 13.2 | 11.8 | 36.0 |
| 0.20 | 13.0 | 11.6 | 35.5 |
| 0.25 | 13.0 | 11.0 | 35.0 |
| 0.30 | 12.8 | 10.5 | 32.0 |
| 0.35 | 12.0 | 8.0 | 22.0 |
| 0.40 | 8.0 | 5.0 | 6.0 |

Example 3

The process of example 1 was carried out, except the composition was $(Sm_{0.9}Pr_{0.1})_{9.0}Fe_{bal}Si_yN_{14.0}$. Varying the value of y, the magnetic performance of $(Sm_{0.9}Pr_{0.1})_{9.0}Fe_{bal}Si_yN_{14.0}$ is shown in Table 3.

TABLE 3

Variation of the magnetic properties of $(Sm_{0.9}Pr_{0.1})_{9.0}Fe_{bal}Si_yN_{14.0}$ as a function of y

| y | Br (kG) | iHc (kOe) | $(BH)_{max}$ (MGOe) |
|---|---|---|---|
| 0.0 | 12.5 | 8.0 | 24.0 |
| 0.2 | 12.5 | 10.0 | 28.8 |
| 0.5 | 12.5 | 10.5 | 30.4 |
| 0.8 | 12.5 | 10.7 | 32.8 |
| 1.0 | 13.0 | 11.8 | 34.0 |
| 1.2 | 13.3 | 11.5 | 36.0 |
| 1.5 | 13.5 | 12.0 | 38.0 |
| 1.8 | 13.3 | 12.0 | 37.0 |
| 2.0 | 13.2 | 11.5 | 36.5 |
| 2.3 | 12.0 | 11.0 | 35.0 |
| 2.5 | 11.5 | 10.5 | 32.0 |
| 3.0 | 11.3 | 10.2 | 31.5 |
| 4.0 | 10.5 | 9.0 | 28.0 |
| 5.0 | 10.0 | 9.0 | 25.0 |
| 6.0 | 9.0 | 8.0 | 23.0 |

Example 4

The process of example 1 was carried out, except the composition was $(Sm_{0.9}Pr_{0.1})_{9.0}Fe_{bal}V_yN_{14.0}$. Varying the value of y, the magnetic performance of $(Sm_{0.9}Pr_{0.1})_{9.0}Fe_{bal}V_yN_{14.0}$ is shown in Table 4.

TABLE 4

Variation of magnetic performance of $(Sm_{0.9}Pr_{0.1})_{9.0}Fe_{bal}V_yN_{14.0}$ as a function of y

| y | Br (kG) | iHc (kOe) | $(BH)_{max}$ (MGOe) |
|---|---|---|---|
| 0.0 | 12.5 | 8.0 | 24.0 |
| 0.2 | 12.5 | 10.0 | 28.8 |
| 0.5 | 12.5 | 10.5 | 30.4 |
| 1.0 | 12.8 | 12.0 | 32.8 |
| 1.5 | 12.8 | 12.3 | 33.0 |
| 2.0 | 12.9 | 12.5 | 34.5 |
| 2.6 | 13.0 | 12.8 | 36.0 |
| 3.0 | 13.2 | 13.0 | 37.0 |
| 3.5 | 13.0 | 13.3 | 37.5 |
| 4.0 | 12.6 | 12.5 | 34.0 |
| 4.5 | 12.5 | 12.0 | 33.0 |
| 5.0 | 11.3 | 11.2 | 31.5 |
| 6.0 | 10.5 | 9.0 | 28.0 |
| 7.0 | 10.0 | 9.0 | 25.0 |
| 8.0 | 9.0 | 8.0 | 23.0 |

Example 5

The process of example 2 was carried out, except the composition was changed. A partial substitution of Pr with Nd, Gd or Y, partial substitution of Si with V, Ni, Nb or Mo, and partial substitution of N with C were made. These substitutions help to further improve the magnetic properties and their stability. The magnetic performance of substituted magnetic powder is shown in Table 5 below.

TABLE 5

Performance of the substituted magnetic powder

| Magnetic powder | Br (kG) | iHc (kOe) | $(BH)_{max}$ (MGOe) |
|---|---|---|---|
| $Sm_{8.0}Pr_{0.5}Nd_{0.7}Fe_{bal}Si_{0.8}V_{1.8}N_{14.0}$ | 13.0 | 12.5 | 37.8 |
| $Sm_{8.0}Pr_{0.8}Gd_{0.4}Fe_{bal}Si_{0.6}V_{2.0}N_{14.0}$ | 12.5 | 13.0 | 36.8 |
| $Sm_{8.0}Pr_{1.0}Y_{0.2}Fe_{bal}Si_{0.4}V_{3.2}N_{14.0}$ | 13.8 | 12.0 | 39.0 |

TABLE 5-continued

Performance of the substituted magnetic powder

| Magnetic powder | Br (kG) | iHc (kOe) | $(BH)_{max}$ (MGOe) |
|---|---|---|---|
| $Sm_{9.0}Pr_{1.2}Fe_{bal}Si_{0.2}Ni_{3.0}C_{5.0}N_{9.0}$ | 13.5 | 12.5 | 38.0 |
| $Sm_{9.0}Pr_{0.1}Fe_{bal}C_{3.0}Si_{1.0}Nb_{0.8}N_{11.0}$ | 13.0 | 12.0 | 37.5 |
| $Sm_{8.0}Pr_{0.2}Nd_{0.8}Fe_{bal}C_{1.0}V_{3.0}N_{13.0}$ | 13.6 | 12.3 | 38.0 |
| $Sm_{9.0}Pr_{1.2}Fe_{bal}Ni_{2.0}Si_{0.1}V_{3.5}N_{14.0}$ | 13.8 | 12.3 | 39.0 |
| $Sm_{9.0}Pr_{1.2}Fe_{bal}Si_{0.1}Mo_{3.5}N_{14.0}$ | 12.8 | 13.0 | 37.5 |

Example 6

An anisotropic calender magnet was prepared according to the following weight percent: 93 wt % of magnetic powder of $Sm_{7.8}Pr_{1.2}Fe_{bal}Si_{0.8}V_{3.0}N_{14.0}$, 5.4 wt % of chlorinated polyethylene (CPE) as binder, 0.8 wt % of coupling agent, 0.3 wt % of epoxide derivative as plasticizer, and 0.5 wt % of ketoamine compound as antioxidant. The average size of the magnetic particles is 2.1 μm. All the above components were blended. Then calendering was carried out. The rolls temperature is 50° C., the preheat time was 150 minutes. The velocity ratio between the front and back rolls is 1.15:1. The distance between two rolls is 0.3 mm. After calendering, the preliminary magnet was calendered to form a sheet calender magnet. In this case, the velocity ratio between the front and back rolls is 1:1. The distance between two rolls is 0.5 mm. The compress rate is 4:1. In order to achieve sufficiently the calender anisotropy, the calendering was made 30 times. Finally, adjusting the distance between the two rolls, a sheet anisotropic calender magnet was formed with a thickness of 2.0 mm.

TABLE 6

The performance of calender flexible magnet of $Sm_{7.8}Pr_{1.2}Fe_{bal}Si_{0.8}V_{3.0}N_{14.0}$

| Br (kG) | iHc (kOe) | $(BH)_{max}$ (MGOe) |
|---|---|---|
| 6.50 | 12.0 | 7.91 |

Example 7

The process of example 6 was carried out until calendering. In order to use the magnetocrystalline anisotropy of the magnetic powder, before calendering, the blend was pressed with a pressure of 1 tone/cm$^2$ in a magnetic field of 15 kOe. So that the blend was preliminary oriented. Then the process was continued as that of example 6, and, to form a sheet calender magnet. As the same of example 6, the velocity ratio between the front and back rolls is 1:1, the distance between two rolls is 0.5 mm, and the compress rate is 4:1. The calendering was made 30 times. Adjusting the distance between two rolls, an anisotropic calender magnet was formed with a thickness of 1.5 mm. The performance is shown in Table 7.

TABLE 7

The performance of calender flexible magnet of $Sm_{7.8}Pr_{1.2}Fe_{bal}Si_{0.8}V_{3.0}N_{14.0}$

| Br (kG) | iHc (kOe) | $(BH)_{max}$ (MGOe) |
|---|---|---|
| 7.0 | 12.0 | 8.8 |

Example 8

The process of example 7 was carried out, except that during calendering a magnetic field was applied. Since the magnetic powder is consisting of single crystal grains which c-axis is the easy magnetization direction, in order to use the magnetocrystalline anisotropy, the calendering contains a magnetic circuit (sintered NdFeB magnets are added around the inner side of rolls). After calendering, the preliminary magnet was calendered in an applied magnetic field to form a sheet magnet. As the same of example 6, the velocity ratio between the front and back rolls is 1:1, the distance between two rolls is 0.5 mm, and the compress rate is 4:1. The calendering was made 30 times. Adjusting the distance between two rolls, an anisotropic calender magnet was formed with a thickness of 2.5 mm. Its performance is shown in Table 8.

TABLE 8

Magnetic performance of flexible calender magnet of $Sm_{7.8}Pr_{1.2}Fe_{bal}Si_{0.8}V_{3.0}N_{14.0}$

| Br (kG) | iHc (kOe) | $(BH)_{max}$ (MGOe) |
|---|---|---|
| 7.50 | 12.0 | 9.5 |

Example 9

The magnet was obtained according to the process of example 8. In order to use the magnetoelastic anisotropy, the magnet was heated again at 100° C. for 10 minutes. After that, it was cooled with a pressure of 10-20 tone/cm$^2$ in a magnetic field of 25 kOe. Its performance is shown in table 9.

TABLE 9

Magnetic performance of flexible calender magnet of $Sm_{7.8}Pr_{1.2}Fe_{bal}Si_{0.8}V_{3.0}N_{14.0}$

| Br (kG) | iHc (kOe) | $(BH)_{max}$ (MGOe) |
|---|---|---|
| 7.8 | 12.0 | 10.3 |

Example 10

Magnetic powder of $Sm_{7.8}Pr_{1.2}Fe_{bal}Si_{0.8}V_{3.0}N_{14.0}$ was blended with thermosetting binder such as epoxy, acrylic or phenolic binder. Then the resulted blend was pressed in a magnetic field to form anisotropic compressing magnet. Its performance is shown in table 10.

The compound is made of 94 wt % of magnetic powder of $Sm_{7.8}Pr_{1.2}Fe_{bal}Si_{0.8}V_{3.0}N_{14.0}$, 5.3 wt % of thermoplastic binder of polyamides or polyester or PVC or PPS, and 0.7 wt % of another ingredients selected from antioxidants, plasticizers, and coupling agent. Then the compound is chopped into small granules. After that the granulated compound is fed into the injection molding machines at a temperature around 200° C. A magnetic circuit is inserted in the moulding equipment with a magnetic field of 10-15 kOe to form anisotropic magnet during injection molding. Its performance is shown in Table 11.

TABLE 10

Magnetic performance of compressing magnet of $Sm_{7.8}Pr_{1.2}Fe_{bal}Si_{0.8}V_{3.0}N_{14.0}$

| Br (kG) | iHc (kOe) | $(BH)_{max}$ (MGOe) |
|---|---|---|
| 9.0 | 12.0 | 16.2 |

TABLE 11

Magnetic performance of injection molding magnet of $Sm_{7.8}Pr_{1.2}Fe_{bal}Si_{0.8}V_{3.0}N_{14.0}$

| Br (kG) | iHc (kOe) | (BH)max (MGOe) |
|---|---|---|
| 8.0 | 8.0 | 12.2 |

Example 11

The process of example 1 was repeatedly carried out with varying the magnetic powder particles size. The dependence of calender magnet's performance as a function of particles size is shown in Table 12.

TABLE 12

Variation of the magnetic performance of calender magnet as a function of particles size

| Average particle size(μm) | Br (kG) | iHc (kOe) | $(BH)_{max}$ (MGOe) |
|---|---|---|---|
| 10 (Not available) | | | |
| 5 | 3.5 | 4.0 | 2.8 |
| 3 | 6.0 | 10.2 | 6.5 |
| 2 | 6.8 | 12.0 | 8.0 |
| 1.5 | 6.5 | 12.5 | 8.0 |
| 1.0 | 5.0 | 12.0 | 6.0 |
| 0.5 | 3.0 | 5.0 | 1.8 |

I claim:

1. An anisotropic rare earth hard magnetic material, which has, on atomic percent basis, a composition of $$(Sm_{1-\alpha}R_{\alpha})_xFe_{100-x-y-z}M_yI_z$$

wherein:

R is Pr alone or a combination of Pr with at least one rare earth element selected from the group consisting of La, Ce, Nd, Gd, Tb, Dy, Ho, Er, Tm, Yb, Lu and Y;

M is at least one element selected from the group consisting of Si, Ti, V, Cr, Mn, Co, Ni, Cu, Zn, Nb, Mo, Al, and Zr;

I is N alone or a combination of N and C;

$0.01 \leqq \alpha \leqq 0.30$;

$7 \leqq x \leqq 12$;

$0.01 \leqq y \leqq 8.0$; and $6 \leqq z \leqq 14.4$; and the anisotropic rare earth hard magnetic material comprises monocrystal particles having a $Th_2Zn_{17}$-structure, of which crystalline grains are in a flake shape with a grain size ranging from 1 to 3 μm, and an easy magnetization direction of the crystalline grains being oriented along a minor axis of the flake crystalline grains.

2. The anisotropic rare earth hard magnetic material according to claim 1, wherein $0.1 \leqq \alpha \leqq 0.30$.

3. The anisotropic rare earth hard magnetic material according to claim 1, wherein said R represents $Pr_{1-\beta}R'_{\beta}$, wherein R' is at least one rare earth element selected from the group consisting of La, Ce, Nd, Gd, Tb, Dy, Ho, Er, Tm, Yb, Lu and Y, $\beta<0.95$, and an atomic percent of Pr in $Sm_{1-\alpha}R_\alpha$ is not less than 1%.

4. The anisotropic rare earth hard magnetic material according to claim 1, wherein said M is selected from the group consisting of Si, V, Ni and a combination of Si—V, Si—Ni, or Si—V—Ni.

5. The anisotropic rare earth hard magnetic material according to claim 1, wherein I is a combination of N and C, and an atomic percent of N in the combination of N and C is not less than 50%.

6. A process for producing the anisotropic rare earth hard magnetic material according to claim 1, comprising the steps of:

(1) preparing a master alloy with all components of $(Sm_{1-\alpha}R_\alpha)_xFe_{100-x-y-z}M_yI_z$ except for N by using strip-casting technique, (2) treating the master alloy obtained in step (1) in nitrogen atmosphere at 450-600° C. for 4-8 hours to carry out a gas-solid phase reaction, to form a nitride having the composition of $(Sm_{1-\alpha}R_\alpha)_xFe_{100-x-y-z}M_yI_z$ as defined in claim 1; and (3) pulverizing the nitride obtained in step (2) into an anisotropic monocrystal powder having an average particle size of 1-3 μm and being in a flake shape.

7. A process for producing anisotropic calender flexible magnet comprising the steps of:

blending the anisotropic rare earth hard magnetic material according to claim 1 with a rubber binder and processing aids to make an elastomeric compound comprising 78-98 wt % of a magnetic powder, 1.5-20 wt % of the rubber binder, and 0.5-10 wt % of the processing aids, and calendering said elastomeric compound repeatedly more than 30 times, with a roll velocity and a distance between the rolls being adjusted to make a specified calender magnet sheet.

8. The process for producing anisotropic calender flexible magnet according to claim 7, wherein a magnetic field is applied during each step of the process.

9. The process for producing anisotropic calender flexible magnet according to claim 8, wherein said magnetic field is produced by a sintered NdFeB magnet or an electromagnet or a pulse electronic magnet and has an intensity of 4-60 kOe.

10. The process for producing anisotropic calender flexible magnet according to claim 7, further comprising heating the calender magnet sheet to a temperature of from 50 to 100° C., and then cooling the calender magnet sheet while compressing it with a pressure perpendicular to the plane of the magnet sheet under a magnetic field of 15-20 kOe, of which direction is the same as that of the compression pressure.

11. An anisotropic magnetic material comprising:

$$(Sm_{1-\alpha}R_\alpha)_xA_{100-x-y-z}M_yI_z$$

wherein $0.01\leqq\alpha$—$0.30$; $7\leqq x\leqq 12$, $0.01\leqq y\leqq 8.0$, and $6\leqq z\leqq 14.4$ on an atomic basis;

R is selected from the group consisting of Pr and a combination of Pr and at least one element selected from the group consisting of La, Ce, Nd, Gd, Tb, Dy, Ho, Er, Tm, Yb, Lu and Y;

M is selected from the group consisting of Si, Ti, V, Cr, Mn, Co, Ni, Cu, Zn, Nb, Mo, Al, and Zr;

I is selected from the group consisting of N and a combination of N and C; and

A is selected from the group consisting of Fe and a combination of Fe and at least one element selected from the group consisting of Mn, Co and Cr, and the anisotropic magnetic material comprises monocrystal particles crystallized in a $Th_2Zn_{17}$ structure, of which crystalline grains are in a flake shape with a grain size ranging from 1 to 3 μm, and an easy magnetization direction of the crystalline grains being oriented along a minor axis of the flake crystalline grains.

12. The anisotropic magnetic material of claim 11, wherein R is $Pr_{1-\beta}R'_\beta$, wherein R' is at least one element selected from the group consisting of La, Ce, Nd, Gd, Tb, Dy, Ho, Er, Tm, Yb, Lu and Y, $\beta<0.95$, and an atomic percent of Pr in $Sm_{1-\alpha}R_\alpha$ is not less than 1%.

13. The anisotropic magnetic material of claim 11, wherein M is selected from the group consisting of Si, V, Ni, and a combination thereof.

14. A magnet comprising the anisotropic magnetic material of claim 11.

15. The magnet of claim 14 wherein the magnet is selected from the group consisting of an anisotropic compressing magnet, an anisotropic injection magnet, an anisotropic extrusion magnet, and an anisotropic calender magnet.

16. The magnet of claim 14 further comprising a binder.

17. A magnet comprising from about 78 to about 98% by weight of an anisotropic magnetic material comprising:

$$(Sm_{1-\alpha}R_\alpha)_xA_{100-x-y-z}M_yI_z$$

wherein $0.01\leqq\alpha\leqq 0.30$; $7\leqq x\leqq 12$, $0.01\leqq y\leqq 8.0$, and $6\leqq z\leqq 14.4$ on an atomic basis;

R is selected from the group consisting of Pr and a combination of Pr and at least one element selected from the group consisting of La, Ce, Nd, Gd, Tb, Dy, Ho, Er, Tm, Yb, Lu and Y;

M is selected from the group consisting of Si, Ti, V, Cr, Mn, Co, Ni, Cu, Zn, Nb, Mo, Al, and Zr;

I is selected from the group consisting of N and a combination of N and C; and

A is selected from the group consisting of Fe and a combination of Fe and at least one element selected from the group consisting of Mn, Co and Cr, and the anisotropic magnetic material comprises monocrystal particles crystallized in a $Th_2Zn_{17}$ structure, of which crystalline grains are in a flake shape with a grain size ranging from 1 to 3 μm, and an easy magnetization direction of the crystalline grains being oriented along a minor axis of the flake crystalline grains;

from about 1.5% to about 20% by weight of a binder; and from about 0.5% to about 10% by weight of processing aids.

18. The magnet of claim 17 wherein the magnet is an anisotropic calender magnet.

* * * * *